US009216842B2

(12) United States Patent
Grodsky et al.

(10) Patent No.: US 9,216,842 B2
(45) Date of Patent: Dec. 22, 2015

(54) STACKABLE SYSTEMS

(71) Applicant: Rich Brands LLC, Phoenix, AZ (US)

(72) Inventors: Mark Douglas Grodsky, Phoenix, AZ (US); Carrie-Anne Moreau, Goodyear, AZ (US); Alicia Marie Thompson, Peoria, AZ (US); Stephanie Ann Golden, Scottsdale, AZ (US)

(73) Assignee: Rich Brands LLC, Phoenix, AZ (US)

( * ) Notice: Subject to any disclaimer, the term of this patent is extended or adjusted under 35 U.S.C. 154(b) by 0 days.

(21) Appl. No.: 14/630,353

(22) Filed: Feb. 24, 2015

(65) Prior Publication Data

US 2015/0166221 A1 Jun. 18, 2015

Related U.S. Application Data

(63) Continuation-in-part of application No. PCT/US2014/010815, filed on Jan. 4, 2014.

(60) Provisional application No. 61/507,956, filed on Jul. 14, 2011.

(51) Int. Cl.

| | |
|---|---|
| ***B65D 21/02*** | (2006.01) |
| ***B05B 11/00*** | (2006.01) |
| ***B65D 25/38*** | (2006.01) |
| ***B65D 51/24*** | (2006.01) |

(Continued)

(52) U.S. Cl.

CPC ..... *B65D 21/022* (2013.01); *B05B 11/0037* (2013.01); *B65D 21/0209* (2013.01); *B65D 21/0231* (2013.01); *B65D 25/38* (2013.01); *B65D 51/245* (2013.01); *B65D 83/00* (2013.01); *B65D 83/38* (2013.01); *B65D 2313/00* (2013.01); *B65D 2583/005* (2013.01)

(58) Field of Classification Search

CPC ..... B65D 5/001; B65D 8/3205; B65D 77/06; B65D 21/0209–21/0238; B65D 83/00; B65D 25/38; B65D 83/38; B65D 2583/005; B65D 2313/00; B05B 11/0035; B05B 11/0037

USPC ..... 222/143, 568; 206/229, 581; 220/4.27; 132/112–116

See application file for complete search history.

(56) References Cited

U.S. PATENT DOCUMENTS

| | | | |
|---|---|---|---|
| 3,067,896 | A | 12/1962 | Berg et al. |
| 3,265,254 | A | 8/1966 | Carter et al. |

(Continued)

OTHER PUBLICATIONS

International Preliminary Report on Patentability issued Jul. 14, 2015 for PCT/US2014/010815, 7 pages.

(Continued)

*Primary Examiner* — Kevin P Shaver
*Assistant Examiner* — Robert Nichols, II
(74) *Attorney, Agent, or Firm* — Kilpatrick Townsend & Stockton LLP

(57) ABSTRACT

Embodiments of the present invention relate generally to stackable systems for use on countertops, as travel systems, or anywhere the items contained therein are desired for use. The stackable systems may be used to contain body lotions, crèmes, powders, perfumes, soaps, washes, gels, body scrubs (such as salt or sugar grain-based scrubs), shampoo/conditioner or any other substance to be dispensed. The systems may also feature one or more dispenser features at the front, top, or bottom of a unit in the stackable system. Embodiments also relate to dispenser systems for use in connection with shower curtains or other surfaces.

2 Claims, 12 Drawing Sheets

(51) Int. Cl.
*B65D 83/00* (2006.01)
*B65D 83/38* (2006.01)

(56) References Cited

U.S. PATENT DOCUMENTS

| | | | | | |
|---|---|---|---|---|---|
| 3,341,884 | A * | 9/1967 | Pryor | A45D 34/042 | 132/74.5 |
| 3,371,824 | A | 3/1968 | Goss | | |
| 3,837,553 | A | 9/1974 | Bock | | |
| 4,289,153 | A * | 9/1981 | Paccione | A45D 19/02 | 132/313 |
| 4,562,940 | A * | 1/1986 | Asphar | B67B 7/28 | 222/88 |
| 5,085,346 | A * | 2/1992 | Wright | B65D 77/06 | 222/143 |
| 5,163,587 | A | 11/1992 | Apps et al. | | |
| 5,419,448 | A | 5/1995 | Watson | | |
| 5,535,791 | A * | 7/1996 | Lisec | B65D 77/061 | 141/113 |
| 5,535,908 | A | 7/1996 | Sheu | | |
| 5,967,322 | A * | 10/1999 | Apps et al. | B65D 21/064 | 206/497 |
| 6,554,164 | B1 | 4/2003 | Jones | | |
| 2001/0047951 | A1 * | 12/2001 | O'Connor | A45D 34/04 | 206/575 |
| 2004/0003477 | A1 | 1/2004 | Juran et al. | | |
| 2004/0129600 | A1 | 7/2004 | Gueret | | |
| 2006/0138147 | A1 | 6/2006 | Wagner | | |

OTHER PUBLICATIONS

International Search Report and Written Opinion for PCT/US2014/010815, dated Dec. 9, 2014, 10 pages.

* cited by examiner

STACKABLE SYSTEMS

CROSS REFERENCE TO RELATED APPLICATIONS

This application is a continuation-in-part of PCT/US2014/010815, filed Jan. 4, 2014, which in turn claims the benefit of U.S. Provisional Application No. 61/507,956, filed Jul. 14, 2011, the entire contents of which are hereby incorporated by reference.

FIELD OF THE INVENTION

Embodiments of the present invention relate generally to stackable systems for use on countertops, as travel systems, or anywhere the items contained therein are desired for use. The stackable systems may be used to contain body lotions, crèmes, powders, perfumes, soaps, washes, gels, body scrubs (such as salt or sugar grain-based scrubs), shampoo/conditioner or any other substance to be dispensed. The systems may also feature one or more dispenser features at the front, top, or bottom of a unit in the stackable system. Embodiments also relate to dispenser systems for use in connection with shower curtains or other surfaces.

BACKGROUND

There are often instances when a user may wish to have one or more dispensable items contained in a discrete unit. For example, space on a bathroom vanity or countertop, bedside table, desk, kitchen countertop, or shower ledge is often limited. However, a user may wish to include a number of various items that are easily accessible on such a surface, such as body lotions, crèmes, powders, perfumes, hairspray, soaps, washes, gels, body scrubs (such as salt or sugar grain-based scrubs), sunblock, nail polish remover, shampoo/conditioner or any other substance to be dispensed. Until now, the user would typically have to clutter the working surface with separate bottles of each item, such as a lotion bottle, a perfume bottle, a body scrub bottle, and/or a body wash/soap bottle. Additionally, if the user wishes to use a particular applicator, such as a bath pouf, brush, sponge, foot pumice, bath mitt, scrubber, or so forth, that item is typically a separate item for which the user must also find a separate storage space. Accordingly, improvements for bath and beauty item storage and dispensing, particular liquid or gel-based items, are needed.

BRIEF SUMMARY OF THE INVENTION

The embodiments described herein provide stackable systems for storing and dispensing various substances. The stackable systems described herein help to reduce clutter, spills, and save space in any area the system is being used. Additionally, the stackable systems provide easy dispensing of the stored products.

In one aspect, embodiments of the invention provide a stackable system. The stackable system can include at least two storage units configured to be stackable upon one another. The storage units can be configured for receiving a refill pouch containing a product to be dispensed and having a dispensing member. Each storage unit can include a slot configured to receive the dispensing member of the refill pouch.

In some embodiments, the stackable system can further include a topper unit. The topper unit can be selected from a group consisting of a brush, pouf, bath mitt, a washcloth material, a sponge, a powder puff, a kitchen scrubber, or a pumice stone. In some embodiments, the dispensing member is selected from a group consisting of a spigot, a pump, or a mister. Each storage unit can include an upper rim and a lower base. The upper rim of a first storage unit can be configured to be received by a lower base of a second storage unit. In some embodiments, the at least two storage units are coupled using at least one of a snap fit, a threaded connection, a magnetic connection, or a dove tail connection. In some embodiments, the slot can extend from a bottom edge of each storage unit. In other embodiments, the slot extends from a bottom edge of each storage unit through a top edge of each storage unit.

In another aspect, embodiments of the invention provide a stackable system. The stackable system can include at least two storage units configured to be stackable upon one another. The storage units can be configured to receive a product to be dispensed. Each storage unit can contain a lid protruding from an upper portion of the unit and an internal indentation at a base of the unit. A lid of a first unit can be received in the internal indentation of a second unit in stackable securement.

In some embodiments, the at least two storage units are secured via a snap fit engagement or via threaded engagement. In some cases, the at least two storage units are selected from a group consisting of squeeze tubes, pump containers, atomizer containers, flip top containers, or screw top containers. In some embodiments, the stackable system can include a topper unit. The topper unit is selected from a group consisting of a brush, pouf, bath mitt, a washcloth material, a sponge, a powder puff, a pumice stone, or a cap to cover an atomizer or mister.

In another aspect, the present invention provides a stackable system. The stackable system can include a container configured to store a substance. The container can include a port extending from a surface of the container. The stackable system can further include a dispensing member coupled with the port for dispensing the substance from the container. The stackable system can also include a plurality of storage units configured to be stackable upon one another. The storage units can each have an internal area that holds the container. Each storage unit can include a slot that receives the dispensing member.

In some embodiments, the container can be a pouch. The container may be resealable. In some embodiments, the stackable system may include a topper unit. The topper unit can be selected from a group consisting of a brush, pouf, bath mitt, a washcloth material, a sponge, a powder puff, a pumice stone, or a cap to cover an atomizer or mister. In some embodiments, the dispensing member is removably coupled with the port. The dispensing member can be selected from a group consisting of a spigot, a pump, or a mister.

In another aspect, the present invention provides a method of connecting a stackable system. The method can include inserting a container holding a substance into an internal area of one of a plurality of storage units. The container can include a dispensing member extending from a surface of the container for dispensing the substance. Each storage unit may include a slot that receives the dispensing member of the container. The method can further include coupling a top portion of the one storage unit with a bottom portion of a second of the plurality of storage units. The method can also include coupling a topper with a top portion of the second of the plurality of storage units.

DETAILED DESCRIPTION OF DRAWINGS

Embodiments of the present invention provide stackable systems that may be used on bathroom vanities, shower ledges, desk tops, kitchen countertops, bedside tables, hotel countertops, or any other appropriate surface, or for use as a travel system that is easily packable and prevents inadvertent dispensing of items in a travel bag.

Figure 1A:
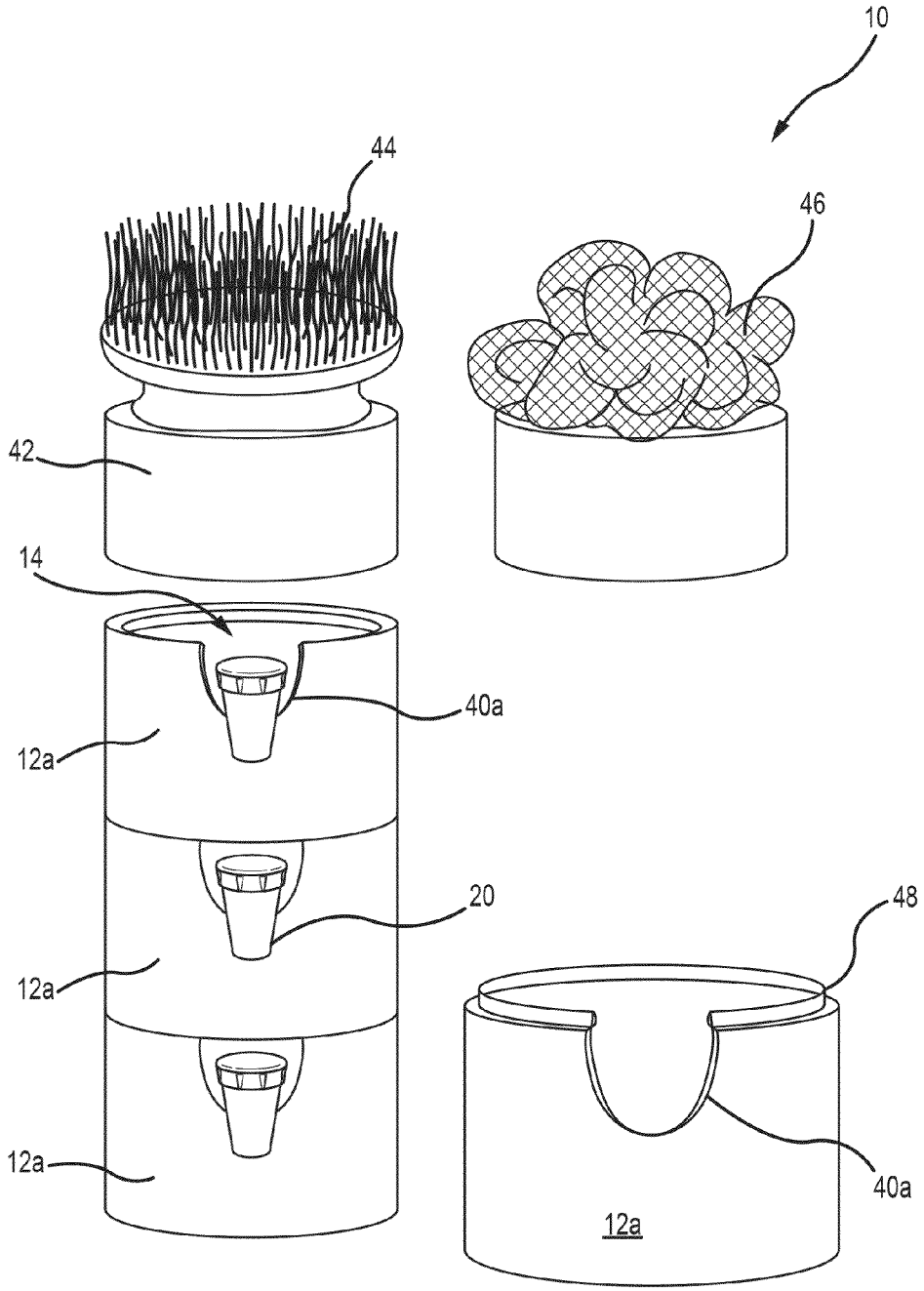
FIG. 1A shows one embodiment of a stackable system described herein.
Figure 1B:
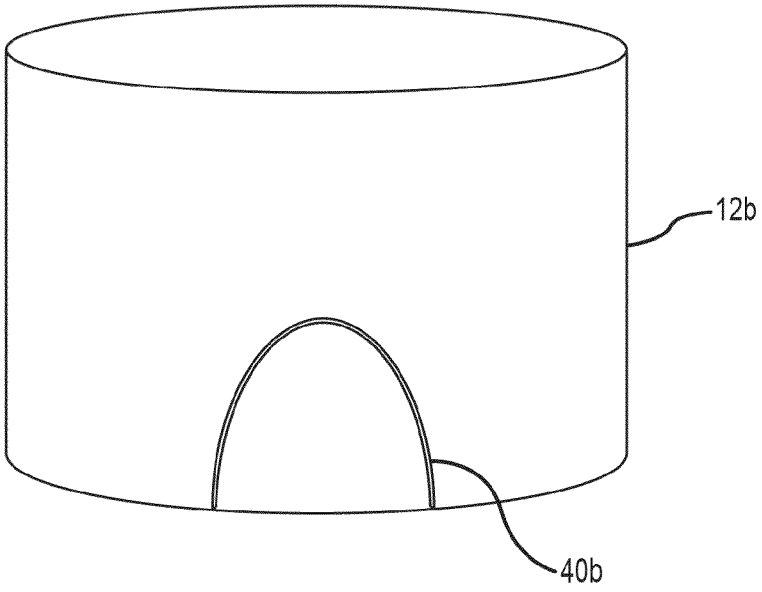
FIGS. 1B-1C show stackable units according to embodiments of the invention.
Figure 1C:
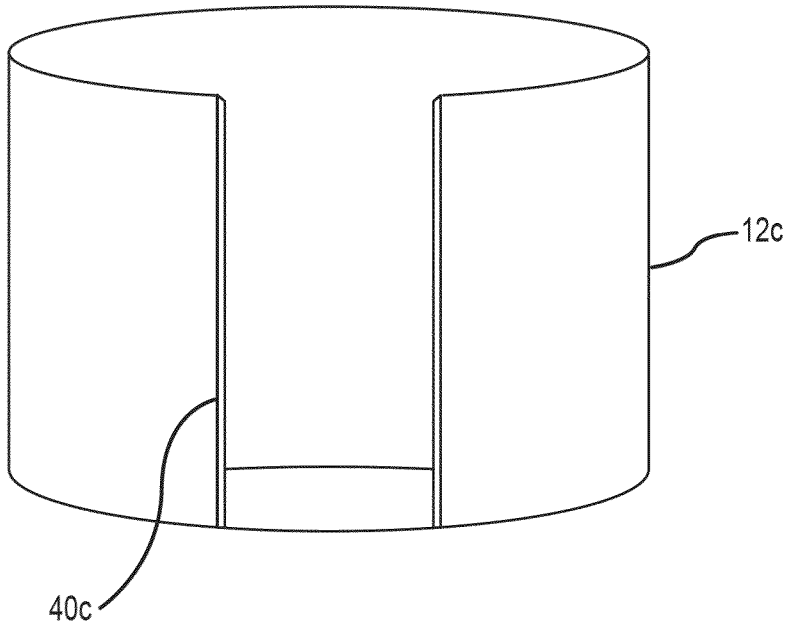
Figure 2A:
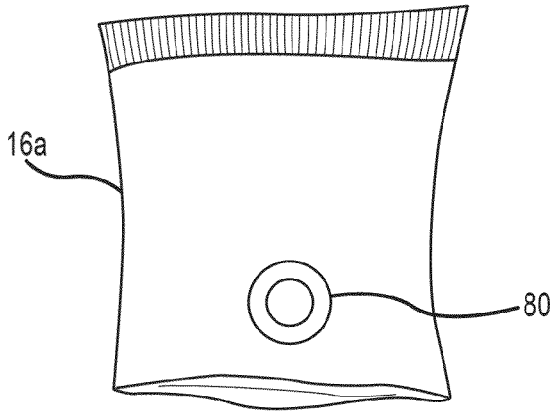
FIGS. 2A-2C show containers according to embodiments of the invention.
Figure 2B:
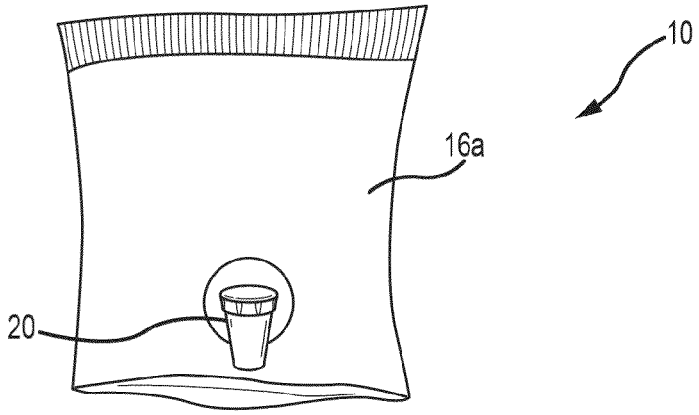
Figure 2C:
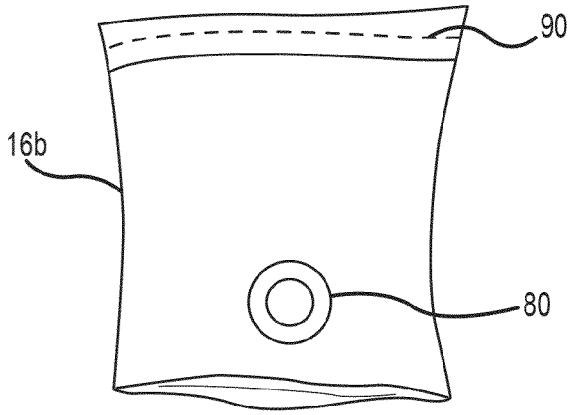

As shown in FIG. 1A, in one embodiment, the stackable system 10 includes at least two storage units 12*a*, although three storage units 12*a* are shown here. Each unit has an internal area 14 for receiving a refill container or pouch, examples of which are shown in FIGS. 2A-2C. Referring back to FIG. 1A, the storage units 12*a* have a slot 40*a* on the front of each unit that allows the dispensing member 20 of the refill pouch to extend through the slot so that dispensing member is outside of the storage unit so as to be easily accessible. The dispensing member 20 is allowed to nest against the slot 40*a* of a first storage unit 12*a* so that another storage unit 12*a* may be stacked on top of the first storage unit 12*a* without interference from dispensing member 20. Slot 40*a* may be a U-shaped indentation that extends from an upper edge of the storage unit 12*a* to mid-way or less than mid-way along the unit body length. Alternatively, slot 40*a* may be any other shape that can accommodate the dispensing member 20. In some embodiments, 40*b* can extend from a bottom edge of the storage unit 12*b* as shown in FIG. 1B, allowing for dispensing member 20 to be positioned at the bottom of the pouch. Positioning slot 40*b* at a bottom edge of the storage unit 12*b* enables the use of dispensing members 20 that utilize gravity to draw the substance from the pouch. FIG. 1C shows an embodiment of the invention that includes a slot 40*c* extending through both the top edge and bottom edge of the storage unit 12*c* to accommodate pouches having dispensing members 20 at various positions and/or pouches having different kinds of dispensing members 20 as discussed herein. It will be understood that while discussion is focused on storage unit 12*a*, storage units 12*a*, 12*b*, and 12*c* can be used interchangeably and in combination with each other in embodiments of the invention.

Figure 1D:
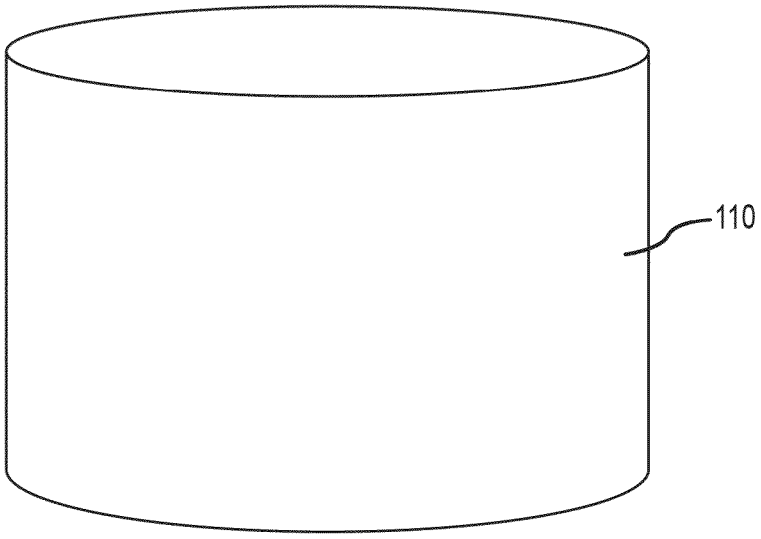
FIG. 1D shows a stand unit according to embodiments of the invention.

FIG. 1D shows an embodiment of a base or stand 110 that can be used in conjunction with the storage units 12*a*, 12*b*, and 12*c*. Stand 110 can elevate a bottom storage unit 12*b* such that the dispensing member 20 is positioned above a supporting structure, such as a countertop. While shown here as a separate stand 110, it will be appreciated that stand 110 can be formed integrally with a storage unit 12*b*, such that dispensing member 20 is still positioned at a bottom of an internal area 14 of the storage unit 12*b* but is elevated from a bottom edge of the storage unit 12*b*. Stand 110 can be of any desired shape and material.

FIG. 1A shows the storage units 12*a* as being generally circular. It should be understood, however, that units may be square, oblong, hexagonal, rectangular or any other shape that has the desired effect. It is generally intended that the units in each system will have a similar general shape, but that is not required. The size of the units may be anywhere from a two-ounce trial size, a 6-ounce size, or up to 10 or 12 ounces, or any other size that is desirable. Storage units 12*a* may be snap fit to one another or they may have a threaded/screw-like cooperation. For example, as shown in FIG. 1A, an upper rim 48 of the storage unit 12*a* may fit into a lower opening of another storage unit 12*a*. In alternate embodiments, storage units may cooperate via magnetic connection, via dove tail/slot, or by any other appropriate connection that allows one unit to stack on top of another. Any number of storage units may be provided and stacked, for example only two storage units may be used, or anywhere up to 10 or more storage units may be used. The only limitation is user preference.

System 10 may be provided with one or more topper units 42. The topper unit 42 may be a brush 44 or a bath pouf 46 as shown, or it may be any other desired option, such as a bath mitt, washcloth material, a sponge, a powder puff, a kitchen scrubber, or a pumice stone. Other options are also possible. In some embodiments, multiple topper units 42 can be used, with one topper unit 42 nesting inside another topper unit 42. For example, brush 44 may be configured to next within a base of bath pouf 46.

It may also be possible to provide an additional unit that does not have the dispensing member slot 40*a*, but that is an enclosed unit for holding a body or face powder or some other substance that may not lend itself to a refill pouch.

System 10 generally provides a build-your-bath concept (or build-your-kitchen), with stackable bath and body products (or soap, oil, gels, and other kitchen-related products). The user can mix and match various fragrances and products provided in various pouches or units 12 in order to provide a custom designed solution for space savings. The refillable nature of the system 10 allows (and encourages) the user to try different trial products and seasonal options that can be inserted into a current system 10. This encourages continuous purchases. The system is beneficial for use in the bathroom or bedroom (for holding various soaps, lotions, hair products (e.g., gels or mousses) or body products), in the shower (for holding soaps, body scrubs, shampoo or conditioner), in the kitchen (e.g., for containing various oils, soaps, or sprays), or on an office desk (for holding lotions and powders). It provides an attractive solution to a messy array of bottles and tubes. The decorative decanter units are stackable and provide an attractive accessory that is also a space-saver. The system 10 further allows a dispensing solution for bulk products when used with pouches that are resealable. Product can be transferred from a bulk size package into a pouch for more convenient use.

FIGS. 2A-2C depict containers or pouches that can be used in conjunction with system 10. As shown in FIG. 2A, the container or pouch 16*a* is generally provided as a flexible bag, but can be of any form that allows for the distribution of a desired substance including other flexible forms or rigid containers. The pouch 16*a* can be sold with the original system 10 or provided separately, such as a sample size of a product or substance. The pouch 16*a* is intended to fit into the storage unit 12*a* such that the product is dispensed directly from the pouch 16*a*. Pouch 16*a* may hold any type of product, such as body wash, body scrub, hand wash, antibacterial gel, hand crème and lotions, hair products, sunblock, perfume, or any other substance. In many cases, the product can be used and dispensed directly from the pouch 16*a*, without having to pour or otherwise transfer it from another container. The pouch 16*a* is mess-free, easy to use, and when emptied or when a new combination of products is desired, the pouch 16*a* can be replaced with a new container or pouch 16*a* of any other product or fragrance.

The pouch 16*a* can include a port 80 for dispensing the product. Port 80 can include any opening that allows the product to be removed from the pouch 16*a*. Oftentimes, port 80 is positioned near a bottom of the pouch 16*a* such that gravity can aid the flow of the product out of the pouch 16*a*. In other embodiments, port 80 can be disposed near a top of the pouch 16*a*. Dispensing members 20 such as misters and pumps that utilize dip tubes can be effective with ports 80 in position near the top.

Figure 3:
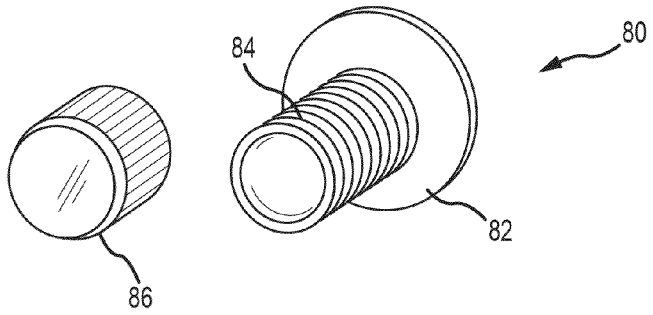
FIG. 3 shows a port according to embodiments of the invention.

FIG. 3 depicts a perspective view of port 80. Port 80 can include a flange 82 that can be attached to pouch 16*a*, for example, by an adhesive. Port 80 can further include a fastener 84 for attaching a dispensing member 20 to pouch 16*a*. In some embodiments, fastener can include a snap fit or magnetic connection, or any other fastener, such as a threaded member as shown here. Fastener 84 can also receive a cap 86. Cap 86 can be any form that can seal the port 80, such as a plug or screw-on cap. Cap 86 is particularly useful when pouch 16*a* is provided by a third-party and pre-filled with a product or to prevent any remaining product from spilling when pouch 16*a* is being replaced.

Referring to FIG. 2B, pouch 16*a* is shown having dispensing member 20 attached to port 80. In FIG. 2B, the pouch 16*a* has a dispensing member 20 associated therewith. Typically, dispensing member 20 is disposed near a bottom portion of the pouch 16*a* to maximize the amount of product that dispensing member can remove from the pouch 16*a*. However, when dispensing member 20 is a pump, mister, or the like, dispensing member 20 can be coupled with a port positioned at a top of the pouch 16*a*.

FIG. 2C shows a resealable pouch 16*b* that enables additional product to be added to the pouch 16*b*. For example, pouch 16*b* can include a sealing element 90 such as a zipper, a snap system, or any other sealing mechanism. As the pouch 16*b* is emptied, a top of the pouch 16*b* can be unsealed using sealing element 90 so that additional product can be poured into the pouch 16*b*. The pouch 16*b* can then be resealed to prevent the product from leaking upon use. Pouch 16*b* can include a port 80 as described above. It will be understood that resealable pouch 16*b* and pouch 16*a* can be used interchangeably in the embodiments described herein.

FIGS. 4A-4E depict embodiments dispensing members 20 that can be used with the stackable system. Dispensing member 20 can include a dip tube that can extend into a portion of the pouch 16*a* that is distal relative to the dispensing member 20. Such a dip tube can allow access to product that is positioned away from dispensing member 20. In some embodiments, the dip tube may be flexible such that the dip tube can always be maneuvered toward a bottom of the pouch 16*a* when the pouch 16*a* is in different orientations. Additionally, use of a dip tube in conjunction with any kind of pump device allows the placement of the dispensing member 20 at a top portion of the flexible bag. The dispensing member 20 may be any appropriate dispensing member that is suitable for the product to be dispensed. Dispensing member 20 can be coupled with a port of the pouch 16*a*. In some embodiments, dispensing member 20 is formed with or adhered to the port. In other embodiments, dispensing member 20 can be removeably coupled with the port such that dispensing member 20 can be replaced if broken, if another type of dispensing member 20 is desired, or if a cap or plug is to be used to seal the pouch 16*a*.

Figures 4A, 4B, 4C:
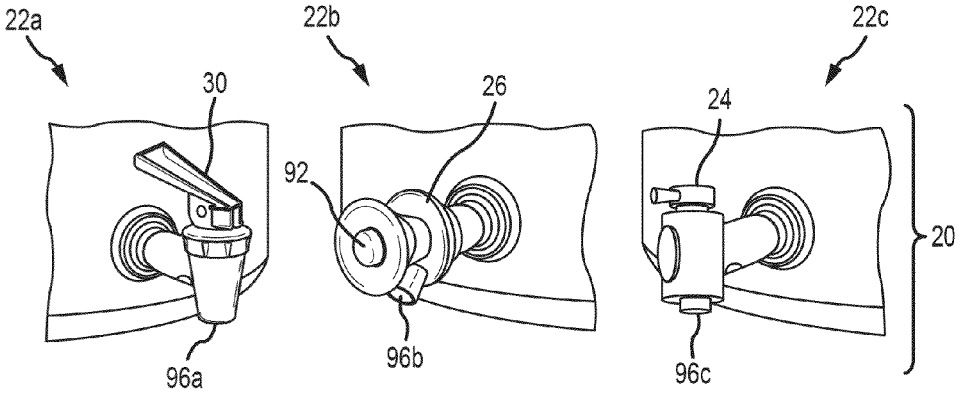
FIGS. 4A-4E show dispensing members according to embodiments of the invention.

For example, if the product is a liquid or substance that otherwise has a generally low viscosity, then a liquid-dispenser spigot such as spigot 22*a*, 22*b*, or 22*c* may be provided. Such spigots 22*a-c* have commonly been used in connection with wine boxes for dispensing the liquid and controlling drips. For example, spigot 22*a*, which is similar to those used on catering drink dispensers, can include a pull lever 30 that controls a fluid valve for dispensing the liquid as shown in FIG. 4A. As a user maneuvers the pull lever 30 from a closed position to an open position, the fluid valve is opened, allowing the product to flow from a pouch through a spout 96*a* of spigot 22*a*. As the pull lever 30 is returned to the closed position, the valve is shut off, preventing the product from flowing from the spout 96*a*.

Other spigots that may be useful in this application can include spigot 22*b* can include a press button 92 and a fingertip grip 26 as shown in FIG. 4B. Typically, a user will place one or more fingers behind fingertip grip 26 and place a thumb over the press button 92. Using the fingertip grip 26 to provide support and/or leverage, the user can push the press button 92 with the thumb, thereby depressing the press button 92. This causes a valve within the spigot 22*b* to open that allows the product to flow through a spout 96*b* of the spigot 22*b*. Upon releasing the press button 92, the valve is shut, stopping the flow of the product. Other embodiments shown in FIG. 4C may use a spigot 22*c* that can include a rotational valve lever 24 that controls the fluid flow of a valve based on how much the rotational valve lever 24 is rotated from a closed position to an open position. The valve prevents product flow in the closed position, and allows product to flow from a spout 96*c* of spigot 22*c* when in an open position. Spigots 22*a-c* may be single flow rate spigots such that the valve either allows for no flow or for maximum flow. In other embodiments, spigots 22*a-c* can be variable flow rate spigots such that the valve can be closed, or opened gradually to provide increasing flow rates as the spigot is operated towards a maximum range of motion.

Figure 4D:
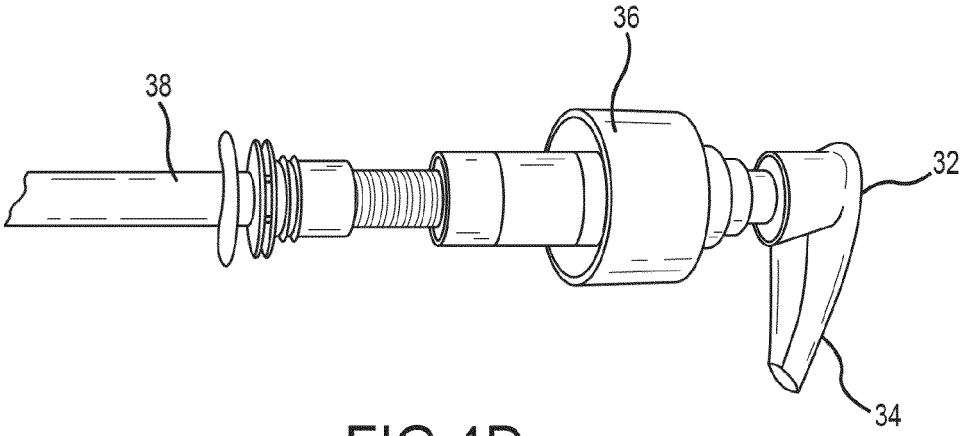

In embodiments where the product to be dispensed is a substance that is more viscous, such as a body scrub or a thick lotion or crème, then the dispensing member 20 may be a pump 32, an example of which is shown in FIG. 4D. Pump 32 generally has a depression head 34 and a connection portion 36, as well as the typical inner workings of a pump spout. The pump 32 may be secured to a pouch, such as pouch 16*a* described above, by coupling connection portion 36 with a port on the pouch. Pump 32 may further include a flexible dip tube 38 that allows it to access product in the pouch. As the depression head 34 is pressed, a measure of product is pushed out of the depression head 34 from the dip tube 38. Upon the depression head 34 being released, a spring inside the pump 32 pushes the depression head 34 back to an initial position and creates a vacuum that draws another measure of product into the dip tube 38. Pump 32 can be configured to provide any desired measure of product upon a single operation of the pump 32.

Figure 4E:
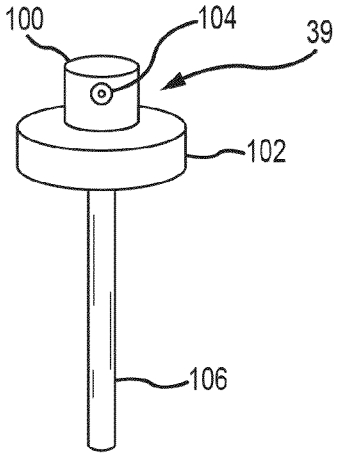

If the product to be dispensed is an atomizable substance, such as perfume, hairspray, or a face spritzer, then the dispensing member 20 may be a mister 39, an example of which is shown in FIG. 4E. Mister 39 can include a connecting portion 102 to couple mister 39 with a port 80 on a pouch 16*a* as described above. Mister 39 can include a flexible or rigid dip tube 106 that allows the mister 39 to dispense a portion of the substance that is distal to the mister 39. Mister 39 can further include a depressible head 100 that can be pressed to expel the substance from the dip tube 106 through a nozzle 104 that atomizes the substance. Upon release of the depressible head 100, a vacuum can be created that draws additional product into the dip tube 106.

Figure 5:
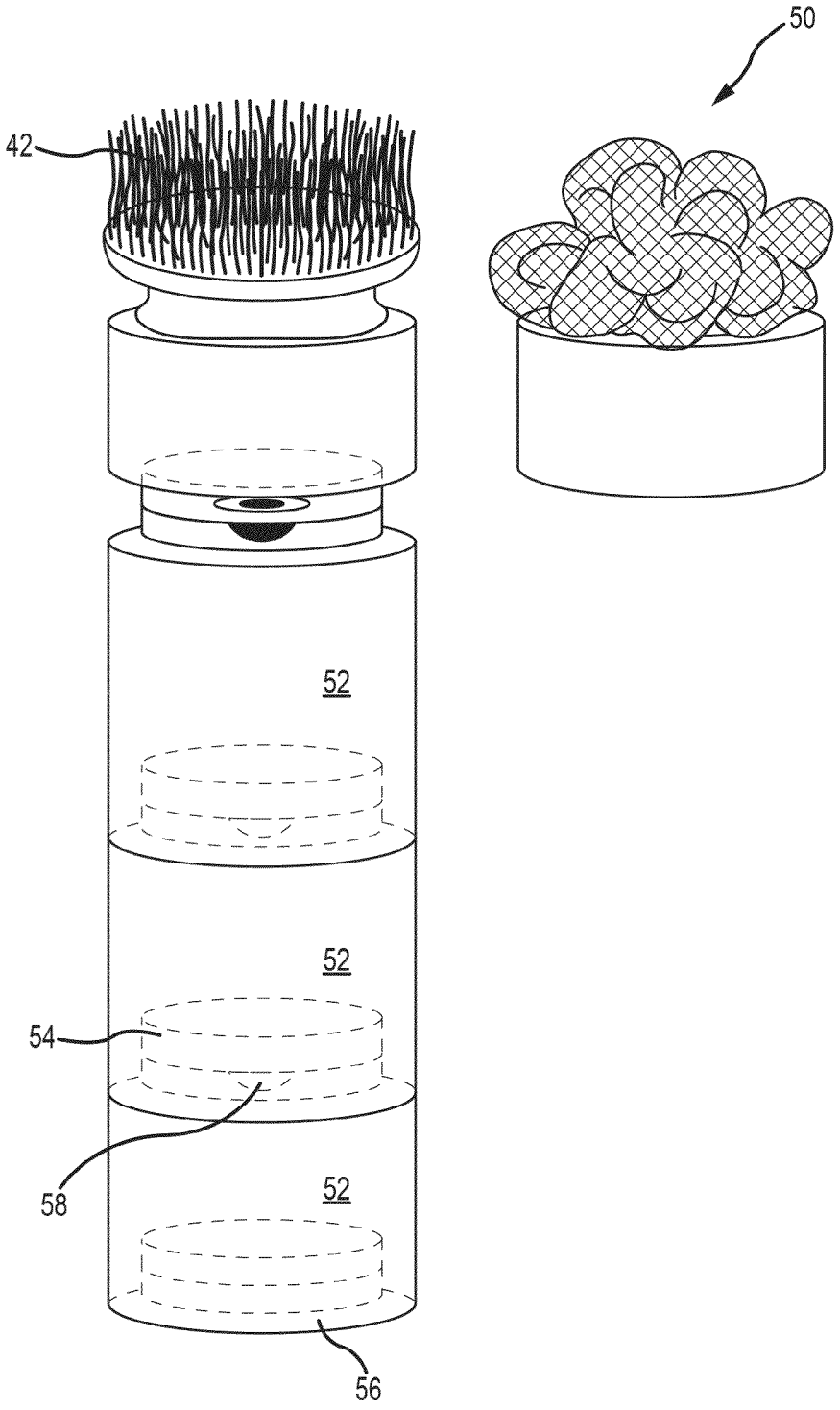
FIG. 5 shows a travel stackable system that features items for use in individual stackable squeeze bottles.
Figure 6:
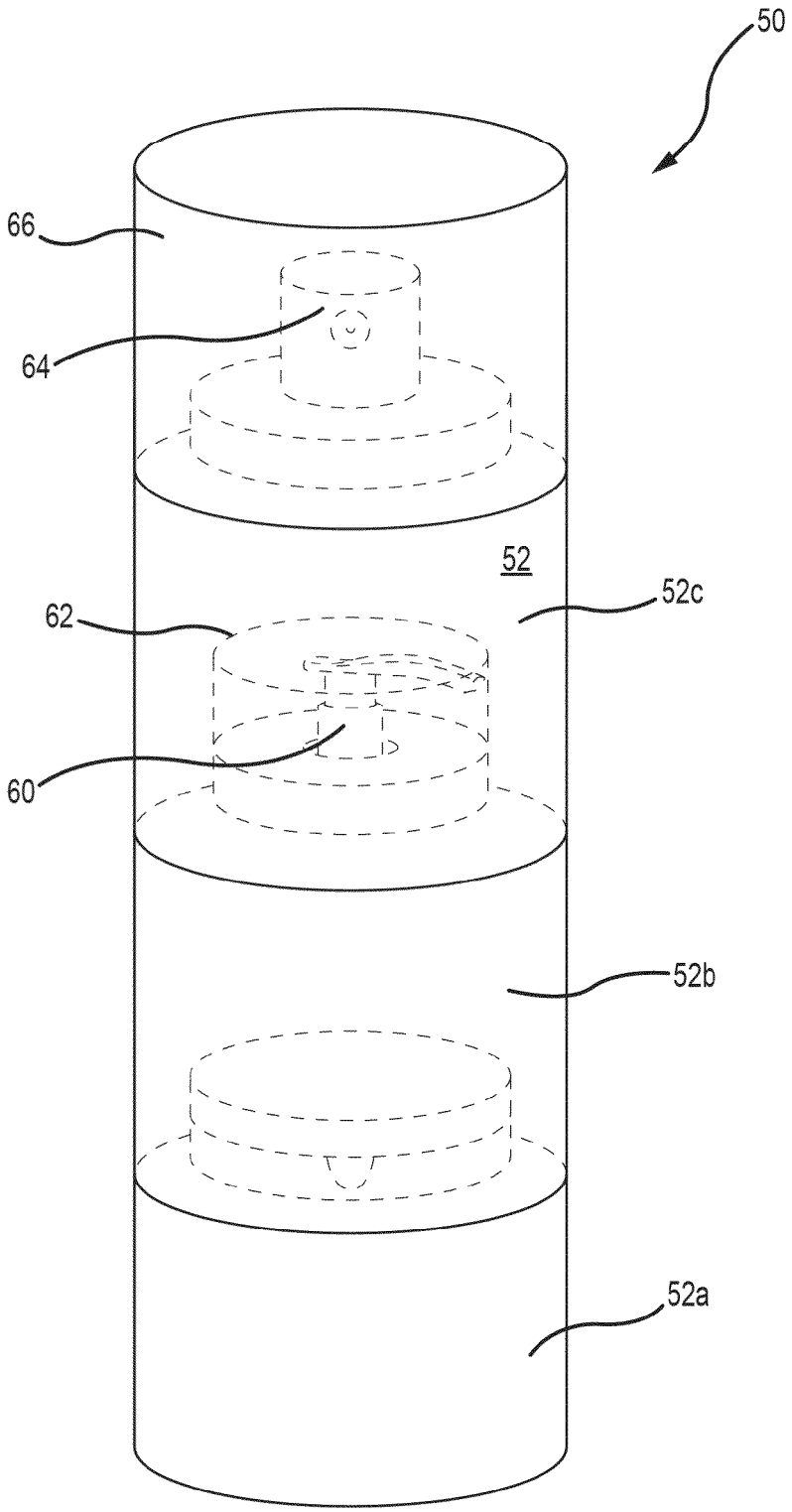
FIG. 6 shows a specific stackable system that features various dispenser options and caps.

Referring now to FIGS. 5 and 6, the stackable system may also be slightly modified for use as a travel system 50. In this embodiment, the system 50 includes a series of units 52 each have a lid 54, which may be a screw on lid, a snap top lid or any other type of lid. A base of each unit 52 has an internal indentation 56 that is generally shaped similarly to the lid 54. There may be a snap feature, a taper fit, or some other member that allows the units 52 to be stackable upon one another and to remain secured to one another during travel. In use, the top of one unit 52 is inserted in the internal indentation 56 of another unit so that the two can snap, screw, or otherwise be secured to one another.

As shown in FIG. 5, it is possible for all of the units 52 to have the same or similar lid 54, for example a lid 54 that has a finger groove 58 for snapping the lid open via a hinge or for snapping the lid 54 completely off the unit 52. Alternatively, as shown in FIG. 6, the units 52 may all have different types of lids, for example a finger groove lid as shown as the lower unit 52*a*, a pump top 60 covered by a cap 62 as shown in the middle unit 52*b*, or a spray mister 64 covered by a cap 66 as shown in the top unit 52*c*. One benefit of this system is that it allows a user to carry multiple components, such as hand crème, lotion, and perfume in one contained travel system 50. This can lend itself to the popular trend of layering fragrances, such as applying a lotion, body powder, and/or perfume in the same fragrance line in order to cause the scent to remain longer. It also allows a user to carry multiple toiletries, such as face wash, body wash, various lotions, perfumes, hairsprays and so forth in a single system.

FIG. 5 also illustrates that various different toppers 42 may also be used in the travels systems 50 described herein. An interchangeable bath brush and a bath pouf are shown, but it should be understood that any other possibilities may be used. For example, the topper unit 42 may be a brush 44 or a bath pouf 46 as shown, or it may be any other desired option, such as a bath mitt, washcloth material, a sponge, a powder puff, a kitchen scrubber, or a pumice stone. Additionally, multiple toppers 42 may be used by nesting one topper 42 within another topper 42.

Figure 7:
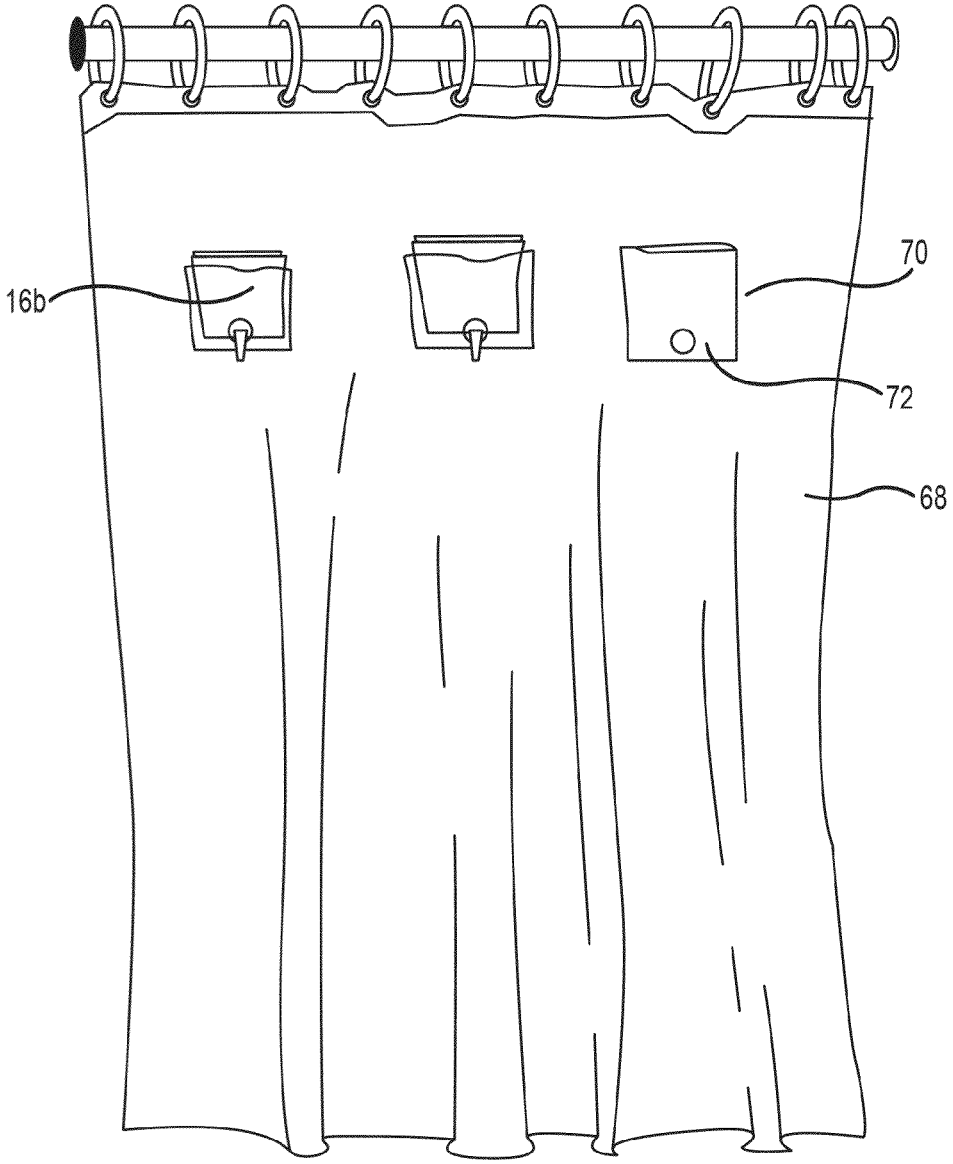
FIG. 7 shows an alternate pocket for a pouch dispenser system that may be used in connection with a shower curtain or other surface.

FIG. 7 shows an alternate embodiment that expands on the pouch concept described above. In this system, the refill pouches 16*b* may be used in a shower curtain 68 or other fabric, plastic, or bathroom liner. The curtain 68 is provided with one or more pockets 70 formed therein, which may simply be an extra flap of material or plastic adhered to the curtain. The pocket 70 generally has an opening or slit 72 configured to accommodate the dispensing member 20 of one of the pouches 16*b*. Alternatively, adhesive pockets 70 may be formed separately and sold with the pouches 16*b* so that the user may apply the pockets 70 to any desired surface for use with the pouch 16*b*. For example, a pocket 70 may be applied to a shower curtain 68, a mirror, a closet door, a shower door, a shower wall, a bathroom wall, or anywhere else that the product contained in the pouch is desired to be used.

Figure 8:
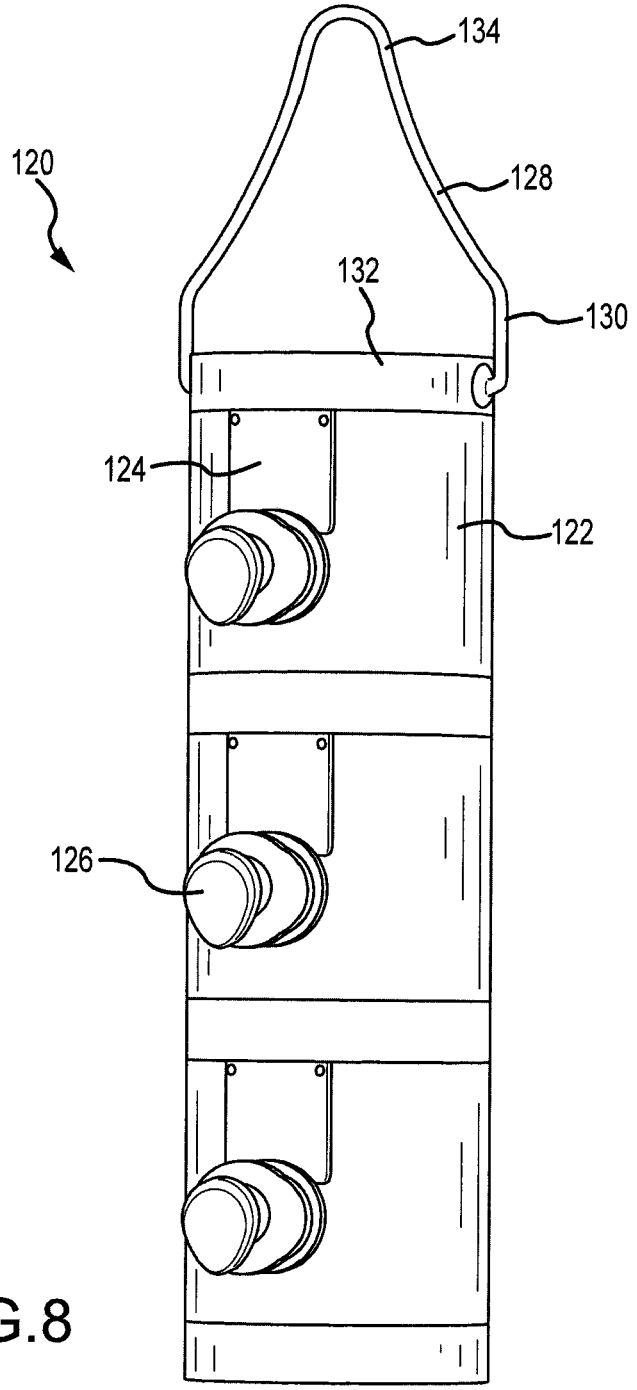
FIG. 8 shows a hangable stackable system according to embodiments.

FIG. 8 depicts an embodiment of a hangable stackable system 120. Hangable stackable system 120 may have similar features as the stackable systems and pouches described above in FIGS. 1-7. For example, stackable system 120 may include one or more storage units 122 that are stackable on one another. Pouches (not shown, but similar to pouches 16*a* described above) may be received within an inner chamber of each of the storage units 122. Each pouch may contain a product to be dispensed, such as by using a dispenser 126. In some embodiments, the pouches may be single-use pouches, while in other embodiments, the pouches may be refillable. An identifier plate 124 may be included to identify contents of a pouch and/or storage unit 122. Identifier plates, such as identifier plates 124, will be discussed in greater detail with regard to FIG. 9 below.

A topmost or other upper storage unit 122 may include a hanging mechanism 128. For example, hanging mechanism 128 may be coupled to opposite sides of the topmost storage unit 122 or a topper unit 132 and extend above the topmost storage unit 122. The hanging mechanism 128 may be designed to fit over a door handle, a shower head, a hook, and/or any other support feature such that the stackable system 120 may hang from the support feature and be supported by the hanging mechanism 128. For example, the hanging mechanism 128 may be tapered such that a portion 130 of the hanging mechanism 128 proximal to the topmost storage unit 122 is sufficiently large to receive a support features such as a shower head or door knob. A distal portion 134 of the hanging mechanism 128 may be smaller to more securely hold the stackable system 120 in place. In other embodiments, the hanging feature may be hook-shaped, and may be coupled at the sides of the topmost or another upper storage unit 122 and/or on a top of the topmost storage unit 122. The hanging mechanism 128 may be removably coupled to the storage unit 122 and/or a topper unit 132, such as topper units 42 and 136-142. For example, each storage unit 122 and/or topper unit 132 may have an indentation and/or other mating feature that may engage with a corresponding mating feature on the hanging mechanism 128. For example, the hanging mechanism 128 may have pegs that are insertable into the indentations on the storage unit 122 and/or topper unit 132 to secure the hanging mechanism 128 on the storage unit 122. The hanging mechanism 128 may also be pivotable. For example, the hanging mechanism 128 may pivot about the coupling with the storage unit 122 and/or topper unit 132 such that hanging mechanism 128 may extend above the storage unit 122 in a hanging configuration and can be pivoted against the one or more storage units 122 in a storage configuration.

The hanging mechanism 128 may also include other features, such as a suction cup to help secure the stackable system 120 to a surface. For example, a suction cup may be coupled with a back or side of one or more of the storage units 122 and/or may be coupled with a separate hanging mechanism 128, such as a hook. In some embodiments, the hanging mechanism may be formed from metal, plastic, thread, a cord, and/or any material that is sufficiently strong to support the stackable system 120.

Figure 9:
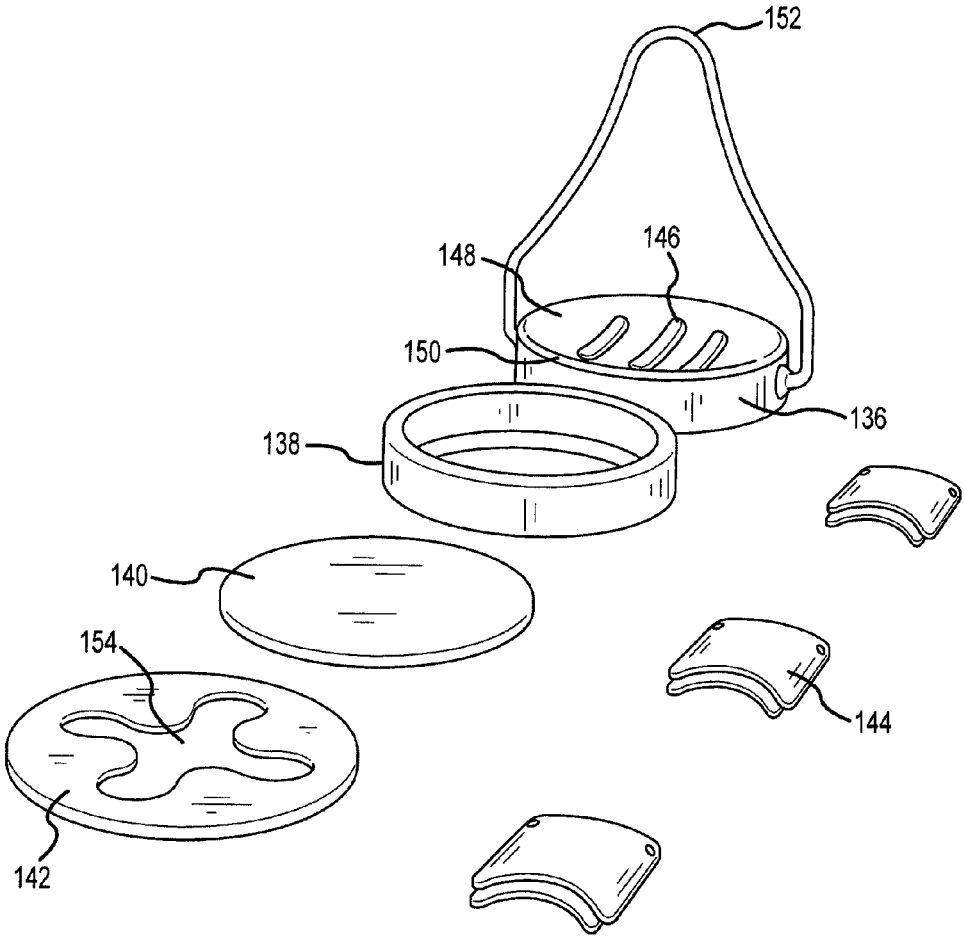
FIG. 9 depicts accessories for use with stackable systems according to embodiments.

FIG. 9 shows various accessories that may be used in conjunction with the stackable systems described herein. For example, a stackable system may include one or more topper units each designed for a specific purpose. Topper units may be configured cover a topmost storage unit, such as by sitting atop to the topmost storage unit. In some embodiments, the topper units may be secured to the topmost storage unit and may be secured using one or more of a twist fit, a snap fit, one or more magnets, one or more clamps, a friction fit, and/or other techniques for removably coupling the topper unit to the storage unit. Topper units maybe selected from a soap dish 136, an edge ring 138, a plain top 140, a toothbrush holder 142, and/or other topper units. In some embodiments, a hanging mechanism, such as hanging mechanism 128 described above may be coupled to a topper unit. For example, hanging mechanism 152 may be coupled to soap dish 136. It will be appreciated that a hanging mechanism may be included on any type of topper unit and/or some or all of the topper units may not include a hanging mechanism.

Soap dish 100 may include one or more ridges 146 that support a bar of soap above a main surface 148 of the soap dish 136 such that the bar of soap is elevated above any water or other liquid that has pooled or otherwise collected on soap dish 136. In some embodiments, the ridges 146 may extend above an outer rim 150 of the soap dish 136. The main surface 148 may be sloped inward to collect any liquid below the height of ridges 146, or may be sloped outward to allow water or other liquid to drain from the soap dish 136.

Ring 138 may be configured to couple with and/or conceal a top edge of the topmost storage unit. Ring 138 leaves an interior of the topmost storage unit accessible while providing a finished appearance to a top edge of the topmost storage unit. This enables the topmost storage unit to hold additional items, such as combs and brushes. A plain top 140 may provide a flat and/or rounded surface atop the topmost storage unit, while also sealing the interior of the topmost storage unit. Toothbrush holder 142 may define one or more apertures 154 that may receive a toothbrush. In some embodiments, a single aperture 154 may have multiple portions or wings such that each wing may receive a separate toothbrush. In this manner, a single aperture 154 provides storage for multiple toothbrushes while separating the toothbrushes from contacting one another.

In some embodiments, an identifier plate 144, similar to identifier plate 124, may be used to label or otherwise identify the contents of a storage unit. For example, an identifier plate 144 may be printed with text and/or images identifying a product. In some embodiments, such an identifier plate 144 may be packaged for sale with a product pouch, such as pouch 16*a*, with which the identifier plate 144 is associated. In other embodiments, identifier plates 144 may be customizable. For example, a preprinted and/or customizable label may be adhered and/or otherwise secured with the identifier plate 144. A customizable label may be written or printed on, such as by including text and/or an image identifying a product within a storage unit. In other embodiments, text or images may be written directly on the identifier plate 144, such as by using a dry-erase or permanent marker.

Identifier plates 144 may be removably coupled with a storage unit. For example, an identifier plate may be slidingly received within a slot of the storage unit, such as slots 40*a*-40*c* described herein. In other embodiments, identifier plates may be secured to a storage unit using one or more of a magnetic or adhesive coupling or a snap connector.

What is claimed is:

1. A stackable system, comprising:

at least two storage units configured to be stackable upon one another, the storage units configured for receiving a refill pouch containing a product to be dispensed and having a dispensing member comprising a push actuated pump, each storage unit comprising a slot on a front of each storage unit configured to receive the dispensing member of the refill pouch; and a topper unit, wherein the topper unit is selected from a group consisting of: a brush, pouf, bath mitt, a washcloth material, a sponge, a powder puff, a kitchen scrubber, or a pumice stone.

2. A stackable system, the system comprising:

a container configured to store a substance, the container comprising a port extending from a surface of the container;

a dispensing member coupled with the port for dispensing the substance from the container, the dispensing member comprising a push actuated pump;

a plurality of storage units configured to be stackable upon one another, the storage units having an internal area that holds the container, each storage unit comprising a slot on a front of each storage unit that receives the dispensing member; and a topper unit, wherein the topper unit is selected from a group consisting of: a brush, pouf, bath mitt, a washcloth material, a sponge, a powder puff, a pumice stone, or a cap to cover an atomizer or mister.

* * * * *